US010723532B2

(12) United States Patent
Milbrandt

(10) Patent No.: US 10,723,532 B2
(45) Date of Patent: Jul. 28, 2020

(54) ELASTIC BAND PACKAGE

(71) Applicant: Bedford Industries, Inc., Worthington, MN (US)

(72) Inventor: Jay A. Milbrandt, Worthington, MN (US)

(73) Assignee: Bedford Insutries, Inc., Worthington, MN (US)

( * ) Notice: Subject to any disclaimer, the term of this patent is extended or adjusted under 35 U.S.C. 154(b) by 98 days.

(21) Appl. No.: 15/964,266

(22) Filed: Apr. 27, 2018

(65) Prior Publication Data

US 2018/0334303 A1 Nov. 22, 2018

Related U.S. Application Data

(60) Provisional application No. 62/509,327, filed on May 22, 2017.

(51) Int. Cl.
*B65D 75/58* (2006.01)
*B65D 73/00* (2006.01)
(Continued)

(52) U.S. Cl.
CPC ..... *B65D 75/5888* (2013.01); *B65D 63/109* (2013.01); *B65D 73/0014* (2013.01);
(Continued)

(58) Field of Classification Search
CPC ..... B65D 75/5888; B65D 73/0014; B65D 73/0021; B65D 73/0028; B65D 73/0064; B65D 75/527; B65D 75/585
(Continued)

(56) References Cited

U.S. PATENT DOCUMENTS 92,895 A 7/1869 Southworth
109,263 A 11/1870 Southworth
(Continued)

FOREIGN PATENT DOCUMENTS

AU 2011224038 10/2011
CN 204632247 9/2015
(Continued)

OTHER PUBLICATIONS

Translation of JP-2002347841 patent, Container with Neck Hanging Label, Publication dated Dec. 4, 2002.
(Continued)

*Primary Examiner* — Chun Hoi Cheung
(74) *Attorney, Agent, or Firm* — Mai-Tram D. Lauer; Westman, Champion & Koehler, P.A.

(57) ABSTRACT

An article includes a panel of elastic material including an elastic strip and a plurality of elastic bands. The elastic strip has opposed first and second longitudinal edges. The plurality of elastic bands are rupturably connected to the first edge of the elastic strip, each of the bands configured as a loop surrounding a first aperture. A method for obtaining an individual elastic band from an article is also described. The article includes a panel of elastic material including an elastic strip and a plurality of elastic bands. The method includes pulling the individual band from the elastic strip to rupture a connection between the individual band and the elastic strip.

20 Claims, 7 Drawing Sheets

(51) Int. Cl.
*B65D 75/52* (2006.01)
*B65D 63/10* (2006.01)

(52) U.S. Cl.
CPC ..... *B65D 73/0021* (2013.01); *B65D 73/0028* (2013.01); *B65D 73/0064* (2013.01); *B65D 75/527* (2013.01); *B65D 75/585* (2013.01)

(58) Field of Classification Search
USPC ..... 206/338–347, 205, 206, 150
See application file for complete search history.

(56) References Cited

U.S. PATENT DOCUMENTS 134,116 A 12/1872 West
161,145 A 3/1875 Moder
212,578 A 2/1879 Smith
224,958 A 2/1880 Rowland
263,600 A 8/1882 Searing
381,879 A 4/1888 Howard
D28,619 S 5/1898 McFadden
D44,124 S 6/1913 Clements
1,221,572 A 4/1917 Morton
1,397,079 A 11/1921 Cohen
D63,105 S 10/1923 King
D64,864 S 6/1924 Pitney
1,830,410 A 11/1931 Shaaf
1,926,553 A 9/1933 Morse
1,929,320 A 10/1933 Lulham
1,995,280 A 3/1935 Everhart
2,012,058 A * 8/1935 Shaw ..... B65D 73/0007 206/460
2,054,641 A 9/1936 Stone
2,057,618 A 10/1936 Keith
D114,257 S 4/1939 Blanchard
2,194,220 A 3/1940 Elder
2,194,898 A 3/1940 Hanford
D123,663 S 11/1940 Bristol
2,298,191 A 10/1942 Boh
2,362,523 A 11/1944 Armstrong
2,516,292 A 7/1950 Bennett
2,516,929 A 8/1950 Van Ackeren
2,635,604 A 4/1953 Fredrickson
2,669,047 A 2/1954 Rieger
2,937,464 A 5/1960 Marshall
2,979,192 A 4/1961 Blonder
3,077,683 A 2/1963 Jones
3,164,250 A 1/1965 Paxton
3,270,872 A * 9/1966 Paxton ..... B65D 33/1625 206/232
3,436,719 A 4/1969 Sheinbaum
3,545,795 A 12/1970 Hertel
3,602,957 A 9/1971 Chang
3,603,551 A 9/1971 Peterson
3,621,809 A 11/1971 Paxton
3,635,367 A 1/1972 Morita
3,662,480 A 5/1972 Gilson
3,744,658 A 7/1973 Fujio
3,749,622 A 7/1973 Sato
3,765,113 A 10/1973 Magee
3,777,378 A 12/1973 Sant'Anselmo
3,783,083 A 1/1974 Jenkins
3,807,679 A 4/1974 Burke
3,896,524 A 7/1975 Parker
3,930,506 A 1/1976 Overend
3,933,560 A 1/1976 Muttera
3,955,656 A 5/1976 Kashinski
4,079,875 A 3/1978 Zodrow
4,119,449 A 10/1978 Gould
D251,121 S 2/1979 Smith
4,296,861 A 10/1981 Barrash
4,323,608 A 4/1982 Denny
4,341,303 A 7/1982 Britt
4,362,239 A 12/1982 Roccaforte
4,363,401 A * 12/1982 Savagian ..... G09F 3/0295 174/DIG. 8
4,390,095 A 6/1983 Cunningham
4,407,082 A 10/1983 Stehouwer
4,412,624 A 11/1983 Tanaka
4,413,741 A 11/1983 Curchack
4,433,498 A 2/1984 Bienz
4,460,143 A 7/1984 Ohama
4,519,178 A 5/1985 Crabb
4,529,229 A 7/1985 Glibbery
4,540,619 A 9/1985 Watanabe
4,706,804 A 11/1987 Hall
4,712,671 A 12/1987 Salacuse
4,749,426 A 6/1988 Wyss
4,916,841 A 4/1990 Dawson
5,018,286 A 5/1991 Zahner
5,087,306 A 2/1992 Cheung
5,131,614 A 7/1992 Garcia
5,207,746 A 5/1993 Jones
D338,195 S 8/1993 Sugarman
RE34,366 E 9/1993 Instance
5,248,164 A 9/1993 Lepretre
5,267,644 A 12/1993 Tsao
5,279,019 A 1/1994 Knickle
5,292,566 A 3/1994 Shacklett
5,322,724 A 6/1994 Levens
5,344,006 A 9/1994 Mazzeo
5,348,781 A 9/1994 Koblella
5,363,576 A 11/1994 Piana
5,367,752 A 11/1994 Petty
5,388,739 A 2/1995 Gargan
5,390,794 A 2/1995 Vulpitta
5,467,897 A 11/1995 Williams
5,490,658 A 2/1996 Coward
5,493,801 A 2/1996 James
5,531,696 A 7/1996 Menes
5,617,656 A 4/1997 Ludlow
5,667,070 A 9/1997 Miret
D385,581 S 10/1997 Linz
D386,211 S 11/1997 Taparauskas
5,683,194 A 11/1997 Emmel
5,697,177 A 12/1997 Ludlow
5,700,537 A 12/1997 Instance
5,713,467 A 2/1998 Kao
5,733,652 A 3/1998 Stowman
5,735,394 A 4/1998 Harrelson
5,766,917 A 6/1998 Wallach et al.
5,778,583 A 7/1998 Larsen
5,782,495 A 7/1998 Grosskopf
5,866,219 A 2/1999 McClure
5,961,434 A * 10/1999 Helseth ..... A47F 13/08 156/296
6,024,225 A 2/2000 Van der Donk
6,036,234 A 3/2000 Chess
6,058,639 A 5/2000 Tinklenberg
6,073,758 A 6/2000 Webster
6,076,669 A 6/2000 Ling
D428,930 S 8/2000 Dunlap
6,116,653 A 9/2000 Oberholzer
6,146,731 A 11/2000 Tanoto
6,182,821 B1 * 2/2001 Olsen ..... B65D 71/504 206/150
6,217,500 B1 * 4/2001 Helseth ..... A47F 13/085 221/26
6,270,834 B1 8/2001 Burrows
6,271,631 B1 8/2001 Burrows
6,279,255 B1 8/2001 Larsen
6,355,403 B1 3/2002 Bourdelais
6,378,700 B1 4/2002 Tong
6,381,890 B1 5/2002 Sjostedt
6,413,122 B2 7/2002 Fujioka
6,449,886 B1 9/2002 Gray
6,490,821 B1 12/2002 Lacek
6,688,023 B1 2/2004 Gwen
6,701,532 B1 3/2004 Glassberg
D494,066 S 8/2004 Liu
D494,998 S 8/2004 Blanke
6,810,811 B2 11/2004 Grounds
D501,892 S 2/2005 Perry
D504,766 S 5/2005 Cassinelli
6,991,261 B2 1/2006 Dronzek

(56) References Cited

U.S. PATENT DOCUMENTS

| | | | | |
|---|---|---|---|---|
| 6,994,246 | B2 | 2/2006 | Ichikawa | |
| 7,086,545 | B2 | 8/2006 | Mannion | |
| D532,049 | S | 11/2006 | Ludlow | |
| 7,143,892 | B2 | 12/2006 | Kolton | |
| 7,281,345 | B2 | 10/2007 | Ludlow | |
| D555,723 | S | 11/2007 | Farr | |
| 7,763,135 | B1 | 7/2010 | Maltas | |
| 7,836,622 | B1 | 11/2010 | King | |
| 7,922,022 | B2 | 4/2011 | Ciarrocchi | |
| 8,047,387 | B2 | 11/2011 | Chalekian | |
| 8,083,126 | B2 | 12/2011 | Fleming | |
| 8,418,844 | B2 * | 4/2013 | Slaters, Jr. | B65D 71/504 206/150 |
| D686,415 | S | 7/2013 | Sassi | |
| D693,813 | S | 11/2013 | Symons | |
| 8,635,795 | B2 | 1/2014 | Ludlow | |
| D712,154 | S | 9/2014 | Schiller | |
| D723,621 | S | 3/2015 | Heinrichs | |
| 9,248,469 | B2 | 2/2016 | Spreck | |
| D756,022 | S | 5/2016 | Shipman | |
| D756,028 | S | 5/2016 | Shipman | |
| 9,355,577 | B1 | 5/2016 | Coleman | |
| D762,985 | S | 8/2016 | Schiller | |
| 9,434,521 | B2 * | 9/2016 | Olsen | B65D 85/67 |
| 9,676,536 | B2 | 6/2017 | Milbrandt | |
| 2003/0096076 | A1 | 5/2003 | Allison | |
| 2003/0150919 | A1 | 8/2003 | Blank | |
| 2004/0028865 | A1 | 2/2004 | Sellars | |
| 2004/0245042 | A1 | 12/2004 | Nevill | |
| 2005/0138854 | A1 | 6/2005 | Simmons | |
| 2005/0166439 | A1 | 8/2005 | Ludlow | |
| 2005/0173073 | A1 | 8/2005 | Chemoff | |
| 2005/0255277 | A1 | 11/2005 | Syron | |
| 2006/0086028 | A1 | 4/2006 | Vaughan | |
| 2006/0091091 | A1 | 5/2006 | Tuan Mu | |
| 2006/0147668 | A1 | 7/2006 | Hirose | |
| 2006/0272185 | A1 | 12/2006 | Malama | |
| 2007/0020423 | A1 | 1/2007 | Chamandy | |
| 2007/0173343 | A1 | 7/2007 | Turnpaugh | |
| 2008/0272011 | A1 | 11/2008 | Levy | |
| 2008/0296192 | A1 | 12/2008 | Tokie | |
| 2008/0301853 | A1 | 12/2008 | Cummiskey | |
| 2009/0152860 | A1 | 6/2009 | Bridges | |
| 2009/0188144 | A1 | 7/2009 | Ludlow | |
| 2010/0006587 | A1 | 1/2010 | Newmark | |
| 2010/0035010 | A9 | 2/2010 | Sellars | |
| 2010/0072794 | A1 | 3/2010 | Karovic | |
| 2010/0139133 | A1 | 6/2010 | Adams | |
| 2013/0239449 | A1 | 9/2013 | Heinrichs | |
| 2017/0372643 | A1 | 12/2017 | Milbrandt | |

FOREIGN PATENT DOCUMENTS

| | | | |
|---|---|---|---|
| DE | 9206368 | | 8/1992 |
| DE | 4402285 | | 11/1992 |
| EP | 1136971 | | 9/2001 |
| EP | 2618324 | A2 | 7/2013 |
| FR | 2634574 | | 1/1990 |
| GB | 451036 | | 7/1936 |
| GB | 2255985 | | 11/1992 |
| GB | 2382810 | | 6/2003 |
| GB | 2405854 | | 3/2005 |
| JP | 2002347841 | | 12/2002 |
| NL | 1016806 | | 6/2002 |
| WO | 96/09920 | A1 | 4/1996 |
| WO | 9824086 | | 6/1998 |
| WO | 0026109 | | 5/2000 |
| WO | 2007084119 | | 7/2007 |
| WO | 2014036246 | | 3/2014 |

OTHER PUBLICATIONS

Cox, H., "Elasticity and strength of paper and other fibrous materials," Br. J. Appl. Phys. 3(72), Mar. 1952, available at http://iopscience.iop.org/0508-3443/3/3/302.

Colom, A., "Analysis of the shape of a sheet of paper when two opposite edges are joined," Am. J. Phys. 74(7), Jul. 2006, available at http://sci-toys.com/bent_paper_problem.pdf.

International Search Report and Written Opinion in Applicant's corresponding application No. PCT/US2018/032240, dated Aug. 20, 2018.

* cited by examiner

FIG. 10
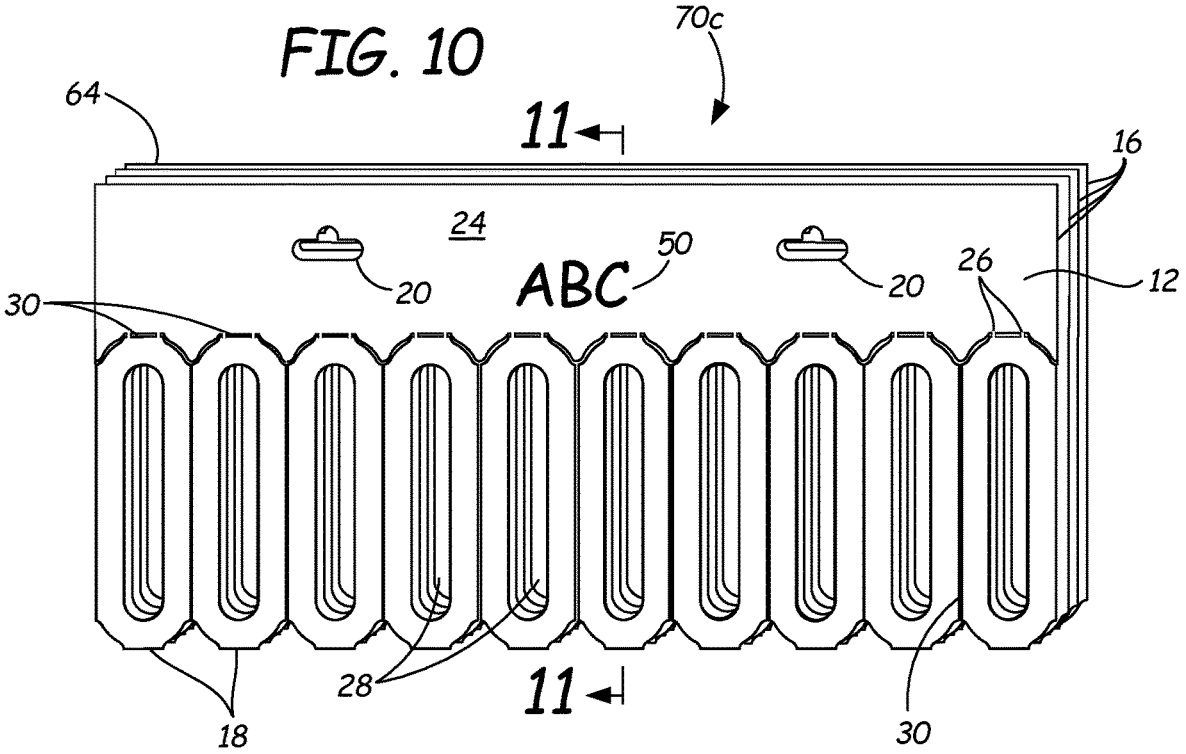
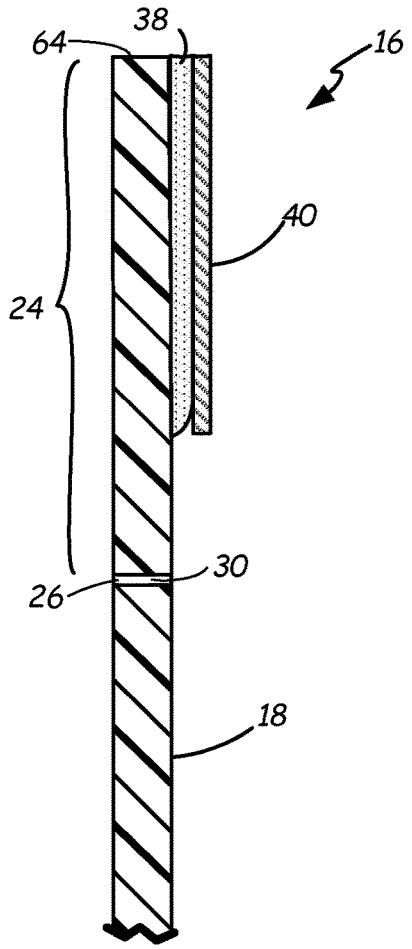
FIG. 11

ELASTIC BAND PACKAGE

CROSS-REFERENCE TO RELATED APPLICATION

This application claims the benefit of priority from U.S. Provisional Patent Application No. 62/509,327, filed May 22, 2017; this priority application is hereby incorporated by reference in its entirety.

BACKGROUND

Endless elastic loops commonly called rubber bands are well known for bundling items together. Such rubber bands are typically provided in a package in which many rubber bands are jumbled together. Because of their configuration, the bands often tangle with each other into a mass from which it can be difficult to separate a single band for use. When using rubber bands in an industrial setting, such as a packaging operation in which the bands are used for bundling or closing items in an industrial process, manual handling of rubber bands can take more time than desired because of the inherent difficulty described above.

SUMMARY

In one aspect, an article includes a panel of elastic material including an elastic strip and a plurality of elastic bands. The elastic strip has opposed first and second longitudinal edges. The plurality of elastic bands are rupturably connected to the first edge of the elastic strip, each of the bands configured as a loop surrounding a first aperture.

In another aspect, a method for obtaining an individual elastic band from an article is described. The article includes a panel of elastic material including an elastic strip and a plurality of elastic bands. The elastic strip has opposed first and second longitudinal edges. The plurality of elastic bands are rupturably connected to the first edge of the elastic strip, each of the bands configured as a loop surrounding a first aperture. The method includes pulling the individual band from the elastic strip to rupture a connection between the individual band and the elastic strip.

This disclosure, in its various combinations, either in apparatus or method form, may also be characterized by the following listing of items:

1. An article including a panel of elastic material including:

an elastic strip having opposed first and second longitudinal edges; and a plurality of elastic bands rupturably connected to the first edge of the elastic strip, each of the bands configured as a loop surrounding a first aperture.

2. The article of item 1 further including a header formed of a sheet material, the header being flatly joined to the elastic strip of the panel.
3. The article of item 2 wherein the header and panel form a sheet assembly, the article including a plurality of said sheet assemblies attached together.
4. The article of item 3 further including adhesive attaching two adjacent sheet assemblies of the plurality of sheet assemblies together.
5. The article of any of items 3-4 further including a mechanical fastener attaching two adjacent sheet assemblies of the plurality of sheet assemblies together.
6. The article of any of items 3-5, wherein each of the headers of the plurality of sheet assemblies includes a second aperture, and wherein said second apertures are aligned to permit passage of a retention mechanism therethrough.
7. The article of any of items 2-6 wherein the header and panel form a sheet assembly, and wherein the sheet assembly is folded to form overlapping portions.
8. The article of any of items 2-7 wherein the header is formed of a substantially inextensible material.
9. The article of any of items 1-8, wherein each elastic band has a length between opposed first and second ends and a width that is perpendicular to the length, and wherein the first end of each of the elastic bands is rupturably connected to the elastic strip.
10. The article of item 9, wherein the length is greater than the width.
11. The article of any of items 1-10, wherein each elastic band is disconnected from each of the other plurality of elastic bands.
12. The article of any of items 2-11, wherein the header overlaps a first side of the elastic strip at an interface, and wherein the elastic strip is bonded to the header at the interface.
13. The article of item 12, wherein an exposed portion of the first side of the elastic strip is provided adjacent the interface.
14. The article of any of items 1-13 including a plurality of overlapping layers of the elastic material.
15. The article of any of items 1-14, further including a second aperture configured to permit passage of a retention mechanism therethrough.
16. A method for obtaining an individual elastic band from an article, the article including a panel of elastic material including:

an elastic strip having opposed first and second longitudinal edges; and a plurality of elastic bands rupturably connected to the first edge of the elastic strip, each of the bands configured as a loop surrounding a first aperture;

the method including pulling the individual band from the elastic strip to rupture a connection between the individual band and the elastic strip.

17. The method of item 16 further including mounting the article on a retention mechanism.
18. The method of item 17 wherein mounting the article on a mechanism includes passing a portion of the mechanism through a second aperture of the article.

This summary is provided to introduce concepts in simplified form that are further described below in the Detailed Description. This summary is not intended to identify key features or essential features of the disclosed or claimed subject matter and is not intended to describe each disclosed embodiment or every implementation of the disclosed or claimed subject matter. Specifically, features disclosed herein with respect to one embodiment may be equally applicable to another. Further, this summary is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The disclosed subject matter will be further explained with reference to the attached figures, wherein like structure or system elements are referred to by like reference numerals throughout the several views. It is contemplated that all descriptions are applicable to like and analogous structures throughout the several embodiments.

FIG. 10 is a front view of a third exemplary embodiment of an elastic band package of the present disclosure.

FIG. 11 is a partial cross sectional view of a sheet of the package of FIG. 10, taken along line 11-11 of FIG. 10.

While the above-identified figures set forth one or more embodiments of the disclosed subject matter, other embodiments are also contemplated, as noted in the disclosure. In all cases, this disclosure presents the disclosed subject matter by way of representation and not limitation. It should be understood that numerous other modifications and embodiments can be devised by those skilled in the art that fall within the scope of the principles of this disclosure.

The figures may not be drawn to scale. In particular, some features may be enlarged relative to other features for clarity. Moreover, where terms such as above, below, over, under, top, bottom, side, right, left, etc., are used, it is to be understood that they are used only for ease of understanding the description. It is contemplated that structures may be oriented otherwise.

DETAILED DESCRIPTION

Figure 1:
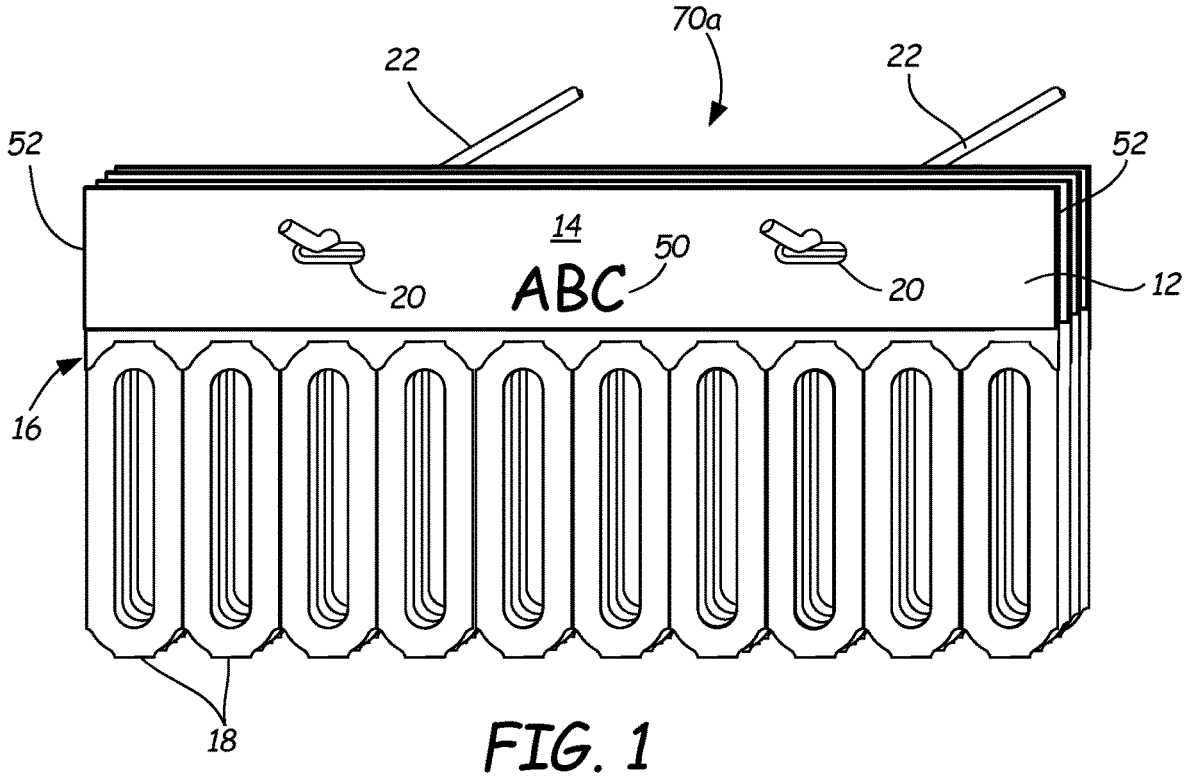
FIG. 1 is a front view of a first exemplary embodiment of an elastic band package of the present disclosure.
Figure 2:
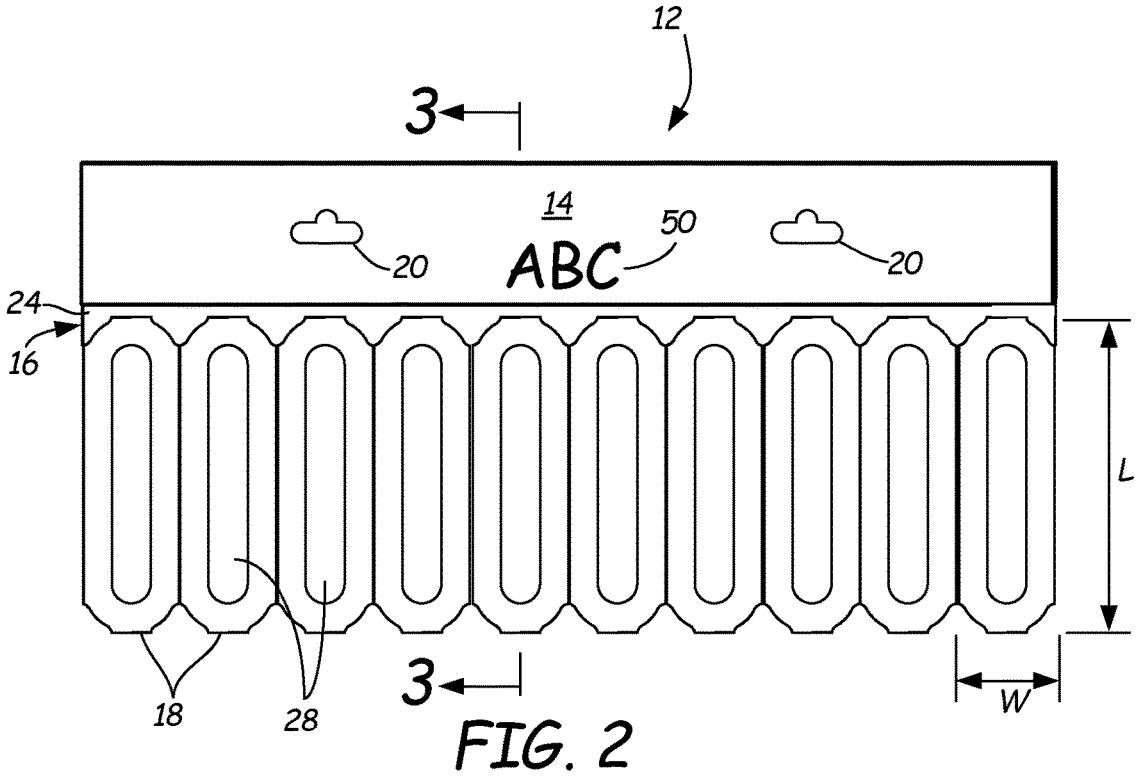
FIG. 2 is a front view of a single sheet assembly of elastic bands.

FIG. 1 is a front perspective view of an elastic band package 70*a* in a first exemplary embodiment. In an exemplary embodiment, package 70*a* is formed of layers of overlaid band sheets 12, one of which is shown in FIG. 2. Band sheets 12 of a package 70*a* can be identical to each other. The overlapping sheets 12 forming package 70*a* can be attached to each other, such as by the use of adhesive, mechanical fasteners such as clamps and rivets, or other attachment mechanisms. Moreover, as shown in FIGS. 1-5, each sheet assembly 12 includes a header 14 attached to an elastic panel 16, which includes ruptureably connected elastic bands 18. Header 14 is provided in some embodiments for ease of handling, and optionally for carrying indicia 50. However, in other embodiments, as shown in FIGS. 10 and 11, for example, an elastic band package 70*c* can includes layers of elastic panels 16 without header 14.

As shown in FIG. 1, one or more headers 14 of package 70*a* can include an attachment feature 20 such as an aperture configured for passage of a retention mechanism such as retention hook 22. In another embodiment, such an attachment feature 20 can be provided on elastic panel 16 rather than on header 14. Attachment features 20 of the multiple layers of elastic panel 16 or headers 14 are aligned to allow such passage of a portion of retention mechanism 22. Moreover, while a particular configuration and placement of attachment features 20 is illustrated, it is contemplated that many other variations of attachment features can also be used, including but not limited to hooks, rivets, clips, other mechanical fasteners such as screws and nails, brackets, hook and loop fasteners, and adhesive, for example. Moreover, while the illustrated attachment feature 20 is provided in each of the band sheets 12, other attachment features may be provided singly for an entire package 70.

FIG. 2 is a front view of a single band sheet assembly 12. In an exemplary embodiment, elastic band package 70*a* is formed by overlaying many band sheets 12 together, with headers 14 aligned in a stacked configuration. In an exemplary embodiment, elastic panel 16 is configured as a layer of flexible elastomer material cut into a plurality of elastic bands 18 ruptureably connected to elastic strip 24. Such cutting can be performed by a laser cutting apparatus, for example. Any number of band sheets 12 can be provided in a package 70, to form a package 70 of convenient size, weight, number of individual bands 18, and other considerations for a particular application. In an exemplary embodiment, package 70 can additionally include a relatively stiff backer card (not shown) to facilitate handling and packaging of one or more packages 70.

Figure 4:
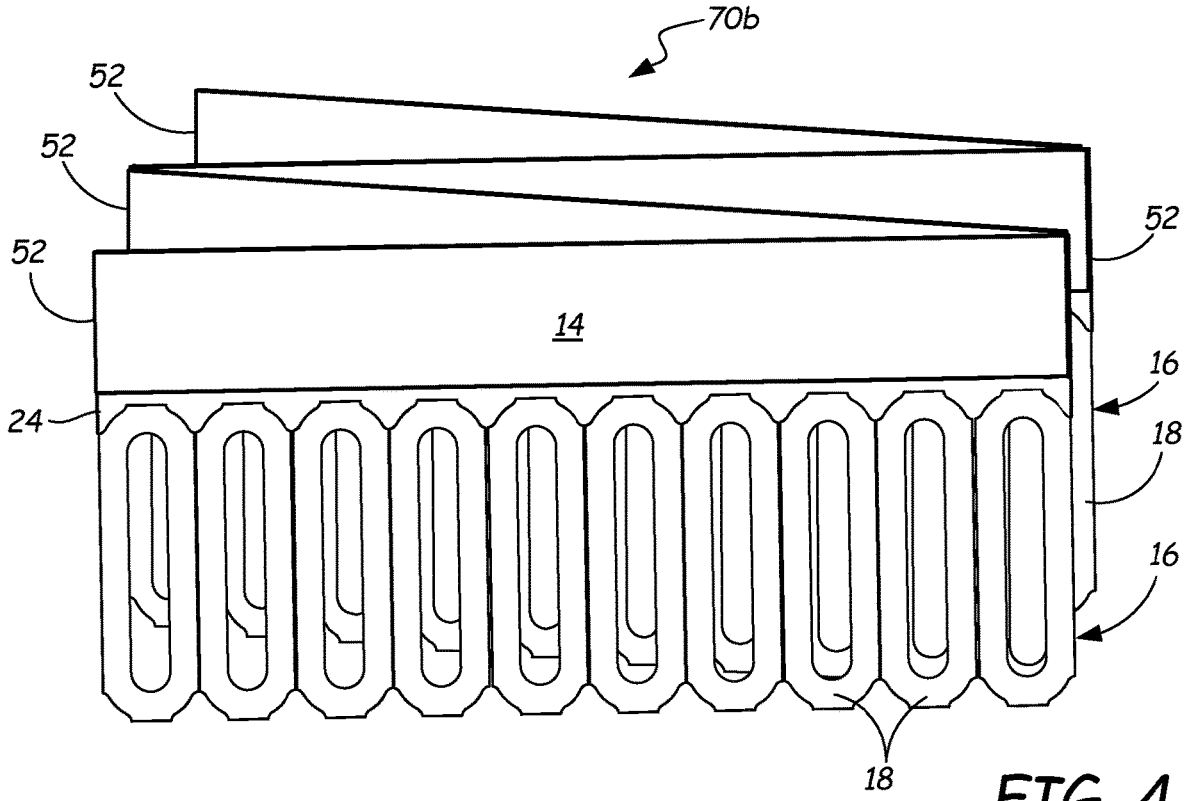
FIG. 4 is a front view of a second exemplary embodiment of an elastic band package of the present disclosure.

FIG. 4 is a front view of a second exemplary embodiment of an elastic band package 70*b* of the present disclosure. In this embodiment, band sheet assembly 12 has a continuous header 14 and continuous elastic strip 24, to which elastic bands 18 are ruptureably connected. In package 70*b*, header 14 is folded at side edges 52 rather than being cut at side edges 52. Thus, package 70*b* is formed with layers of connected, overlapping portions of header 14 and elastic panel 16. The layers can be optionally secured together, such as with adhesive or mechanical fasteners, for example, to form a coherent package 70*b*.

Figure 5:
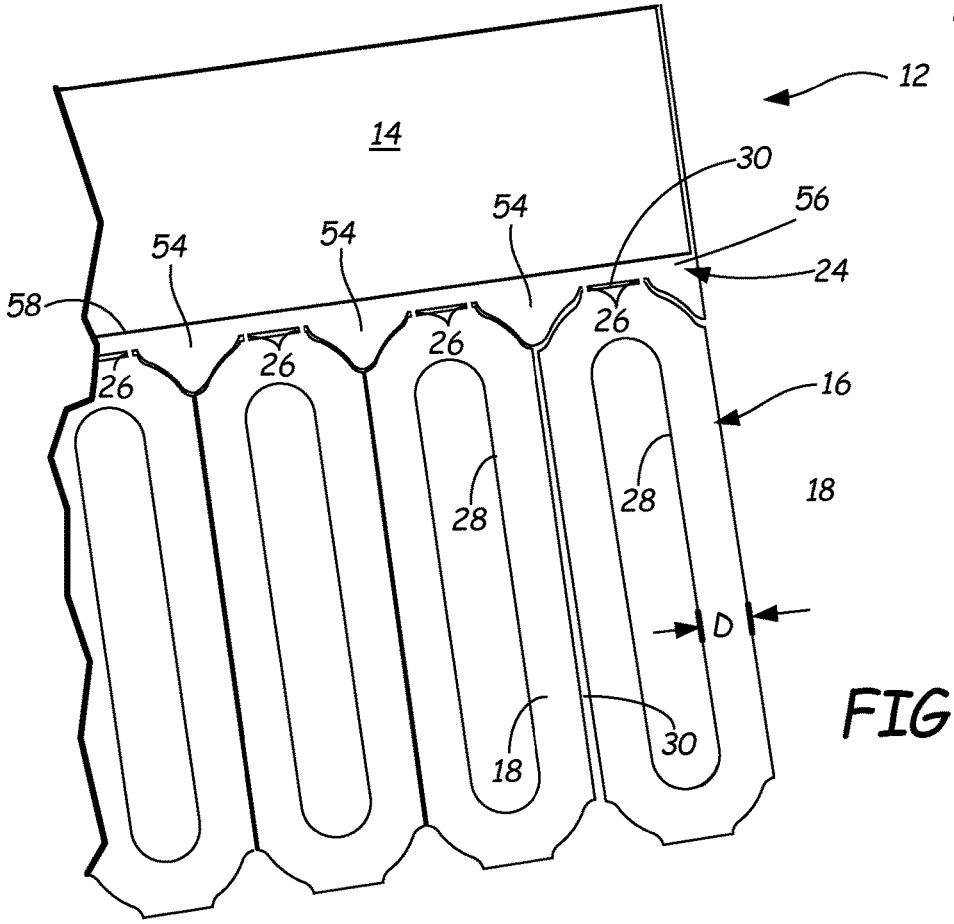
FIG. 5 is an enlarged partial view of a sheet assembly of elastic bands.

FIG. 5 is an enlarged partial view of a portion of sheet assembly 12 of elastic bands 18. In an exemplary embodiment, elastic panel 16 is cut so that each elastic band 18 is attached to strip 24 at joints 26. Moreover, in the illustrated embodiment, each elastic band 18 is fully disconnected from each of the other elastic bands 18 to facilitate removal of an individual elastic band 18 from package 70. In an exemplary embodiment, an elastic band 18 is substantially configured as a loop surrounding aperture 28 and having loop width dimension D. In the illustrated embodiment, joints 26 are located at a top end of each elastic band 18 (assuming that package 70 is suspended via attachment features 20 in the depicted orientation), though other configurations are also possible.

In an exemplary method of manufacture, the contour of outer perimeter cut 30 of each elastic band 18 results in the formation of substantially triangular-shaped elastic portions 54 as part of elastic strip 24. Such elastic portions 54 may lend support to upper ends of the adjacent elastic bands 18. Excess elastomer material (i.e., "weed") resulting from the cutting of aperture 28 is preferably removed. Excess elastomer material near the bottom ends of elastic bands 18 and between adjacent elastic bands 18 (similar in configuration to elastic portions 54) can also be removed. Preferably, such removed weed material is not discarded but rather is recycled and is used as additional elastomer material for manufacturing elastic panel 16. Moreover, aperture 28 may have a very narrow width (e.g., slit-like), so that very little weed is removed.

As shown in FIG. 2, in an exemplary embodiment, each elastic band 18 is formed to have an overall width W that is less than its length L (wherein W and L are measured in substantially perpendicular directions), so that many elastic bands 18 can fit on a given width of header 14 or package 70. While a particular configuration is illustrated for elastic bands 18, it is contemplated that other flat (i.e., sheet-like) band shapes are also suitable, including for example, oval, oblong, elliptical, circular, and other closed polygonal and curved shapes, whether symmetrical or asymmetrical. Moreover, each elastic band 18 can also include one or more additional features, such as a finger-pull gripping tab at a bottom or side of each elastic band 18, for example. Aperture 28 can be shaped other than oblong. In the illustrated embodiment, elastic band 18 has a substantially consistent dimension D between outer perimeter cut 30 and aperture 28. However, it is contemplated that in other embodiments, such a dimension need not be substantially consistent.

Figure 3:
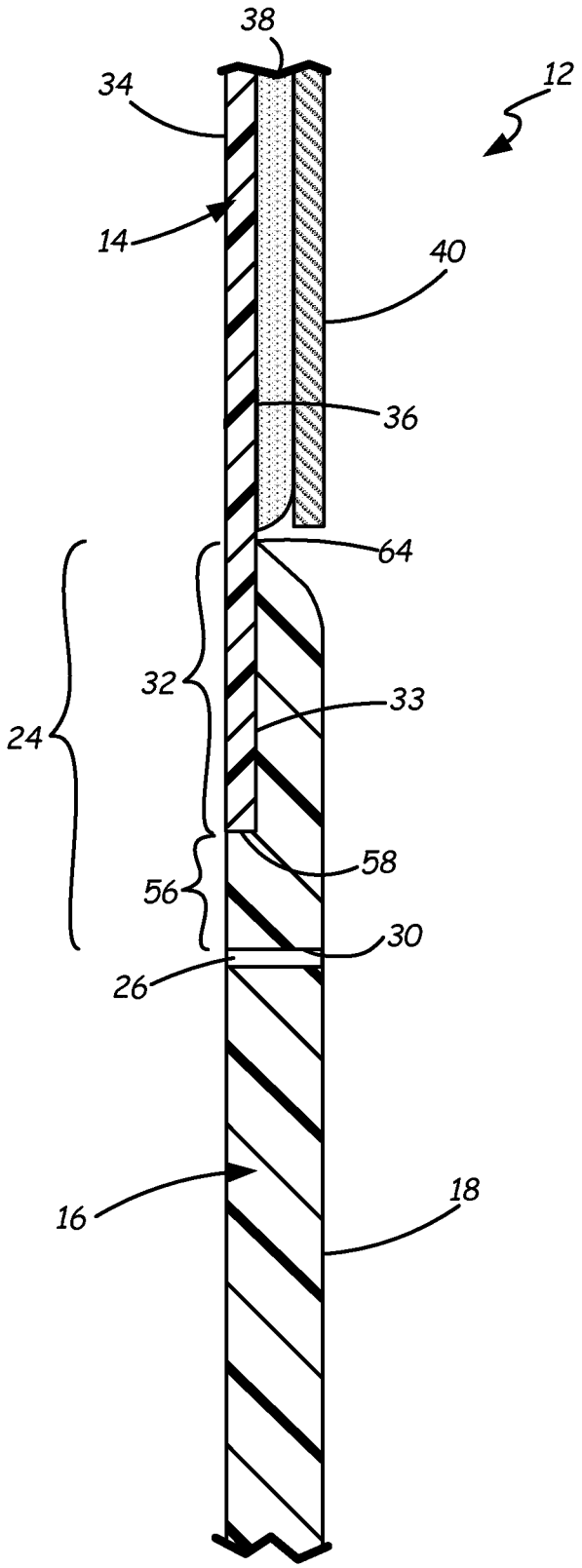
FIG. 3 is a partial cross sectional view of the sheet of FIG. 2, taken along line 3-3 of FIG. 2.

As shown in FIG. 3, band sheet assembly 12 has header 14 joined along a flat bond zone 32 with a flexible elastic panel 16, such as at strip 24. Band sheet assembly 12 is sheet-like in the sense that the elastic panel 16 is formed of a web of elastomeric or other elastic material that is flat in character, and the header 14 is formed of a strip of sheet material that is flat in character, although they may be drapeable and floppy and thus not always displayed in flat form. Header 14 and elastic panel 16 are joined so that the sheet character of each is aligned with the sheet character of the other, giving a total unitary sheet-like character to a band sheet assembly 12.

Bond zone 32 is formed where header 14 overlies and overlaps elastic panel 16. As shown in FIGS. 1 and 2, in an exemplary embodiment, header 14 overlies elastic panel 16 along an entire lower edge of header 14 and an entire upper edge of strip 24 of elastic panel 16. In an exemplary embodiment, bond zone 32 is located at the entire overlapping interface 33 between header 14 and elastic panel 16. However, in other embodiments, header 14 and elastic panel 16 may be bonded together only at portions of the overlapping interface 33. In an exemplary embodiment, header 14 does not cover an entirety of elastic strip 24; rather, an exposed portion 56 (labeled in FIG. 5) of strip 24 is provided between a bottom edge 58 of header 14 and perimeter cut 30 of elastic bands 18. Provision of such an exposed portion 56 ensures that the material and bonding of header 14 does not interfere with separation of elastic bands 18 from elastic strip 24 at joints 26 between portions of perimeter cut 30.

As shown in FIG. 3, in an exemplary embodiment, header 14 includes a front surface 34 and an opposed rear surface 36. An adhesive layer 38 is optionally disposed on rear surface 36 to allow attachment of overlaid headers 14 (of separate sheets 12 or a continuous, folded sheet 12) to each other to form package 70*a*, 70*b*. Many adhesives are suitable, such as known pressure-sensitive adhesives. Moreover, an exemplary embodiment of band sheet assembly 12 includes a release liner 40 disposed over the adhesive layer 38 to optionally protect the adhesive layer 38 from fouling and contamination prior to use.

The thickness of header 14 is great enough to give some body effect but ideally will not be greater than necessary to have the requisite strength for suspension by attachment mechanisms 20 and retention of elastic panel 16 during use without tearing. Header 14 may also carry appropriate indicia 50 to describe or identify a manufacturer of elastic band package 70*a*, 70*b*, instructions for use, or other relevant information or images. Indicia 50 may include informational or decorative matter to be printed, embossed, or otherwise provided on header 14 or elastic panel 16. While illustrated as substantially rectangular, header 14 can be provided by creative cutting of its outer perimeter to provide desired shapes and forms. Moreover, an enhanced visual presentation of an elastic band 18 can also be provided by creative cutting of outer perimeter cut 30 and aperture 28 to provide desired shapes and forms.

Header 14 in an exemplary embodiment is in the form of a strip of sheet material, including sheet material with holes or perforations therethrough (for example, apertures 20 or perforations or scoring to facilitate folding at package side edges 52). A suitable sheet material for header 14 is preferably relatively thin, generally not over about 15 mils (0.015 inch or 0.38 mm) or about 20 mils (0.020 inch or 0.51 mm) in thickness. However, thicknesses up to about 30 mils (0.030 inch or 0.76 mm) or about 40 mils (0.040 inch or 1.02 mm) can be used. The material should be flexible and pliable but is most preferably inextensible (e.g., not stretchable and not elastic) for most applications. For purposes of this disclosure, an elastic material is one that has an initial dimension in a relaxed state; the dimension increases under tension, such as by stretching; moreover, upon release of the tension force, the dimension returns to, or nearly to, the initial unstretched dimension. In an exemplary embodiment, the material for header 14 is sufficiently non-elastic and non-stretchy under hand-applied forces. For example, the sheet material for header 14 can have sufficient dimensional stability to carry a reliably scannable (i.e., non-distorted) print of a UPC code as well as other human-readable or machine-readable markings.

In an exemplary embodiment, the sheet material for header 14 is sufficiently water resistant to not disintegrate and not significantly pucker, wrinkle, or otherwise disfigure or deform when placed in water. Moreover, in an exemplary embodiment, inks or other printing media used for indicia 50 are sufficiently water resistant to avoid disintegration or destruction when repeatedly subjected to water and washing operations (as is common for produce displays in supermarkets). The sheet material for header 14 also should be somewhat tough in the sense of being sufficiently tear resistant to deter damage to it during handling.

Suitable materials for forming the header 14 include paper, polystyrenic thermoplastics, polyolefinic thermoplastics, polyesters, and others. Exemplary suitable thermoplastic materials include polymers of styrene, ethylene, propylene, as well as a variety of other monomers and mixtures of monomers (e.g., to make co-polymers and ter-polymers, etc.). Sheet thickness for polyester plastics and some others can be quite thin, even down to the 3 mil (0.08 mm) or 4 mil (0.10 mm) range, and still exhibit the toughness and the practical non-elasticity desired.

The polymers may be formulated so that printing inks are readily accepted on the surface of the sheet material. Polymers can also be treated with special surface treatments to enhance acceptance of printing inks. The exact structure and composition of suitable sheet materials for header 14 can vary widely. Any of a variety of commercially available inks compatible with or accepted on header 14 and retained thereon, and in any desired color, may be used to print indicia 50. In a case where it is desirable to use a water-soluble ink, a thin film of water-insoluble plastic may be applied over the ink to enhance water resistance of the printed markings.

To increase impact resistance of header 14, a styrene-butadiene-styrene impact modifier can be useful in amounts up to about 40 percent of the weight of a polystyrene material. Headers 14 of such material are highly stable against stretching. They have desired flexibility balanced by a slight stiffness that contributes to ease of handling during manufacture and use. Such headers 14 also can be reliably printed, especially when first subjected to a surface treatment such as, for example, a corona treatment such as available from Pillar Technologies of Hartland, Wis., a division of Illinois Tool Works. The treatment enhances wettability and adhesion characteristics of inks and adhesives on plastic substrates.

In an exemplary embodiment, elastic panel 16 generally has a layer thickness that is greater than the thickness of the header 14 by at least about 20 percent up to about four or five or six times the thickness of the header 14 (as for example where a header 14 having a thickness of only about 6 mils (0.15 mm) to about 8 mils (0.20 mm) is employed). In an exemplary embodiment, a thickness of elastic panel 16 is greater than about twice the thickness of header 14, but usually will not exceed about 30 mils (0.76 mm) or about 35 mils (0.89 mm) when the header 14 thickness lies in what is expected to be the popular range of about 5 mils (0.13 mm) to about 10 mils (0.25 mm). It is conceivable, of course, to form band sheet assembly 12 with a header thickness and elastic panel thickness approximately equal (especially where one employs fusion bonding for the bond zone 32 between the header material and the elastic material). It is also conceivable to use elastic layer thicknesses up to but not usually greater than about 100 mils (2.54 mm).

Referring to FIG. 5, in an exemplary embodiment, the plurality of elastic bands 18 are fully separated from each other and are connected to strip 24 only at joints 26. While the illustrated embodiment shows two joints 26 connecting each elastic band 18 to strip 24, it is contemplated that other configurations of joining mechanisms can also be used, including for example, perforations, score lines, cut lines of full or partial depth, and other mechanisms for forming a ruptureable line or contour of weakness connecting an elastic band 18 to strip 24. Moreover, while a particular shape and configuration of the joint 26 between the elastic band 18 and strip 24 is illustrated, it is contemplated that other forms and shapes can be used. As shown in FIG. 5, an outer perimeter cut 30 is provided around each elastic band 18, except in the areas of joints 26.

In use, package 70 may be mounted by attachment features 20 to retention mechanism 22, or by other features or fasteners to a convenient location in a packaging facility, for example. A user can then use one hand to tug gently at an individual elastic band 18 to rupture the joints 26 holding that band to the strip 24 and the rest of package 70. Thus, an individual band 18 is easily removed for use without requiring a user to untangle a single band from a mass of tangled bands. After all the bands 18 of a package 70 have been removed, the headers 14 with attached elastic strips 24 can be removed from retention mechanism 22 and a new package 70 mounted thereon for use. While a particular embodiment of a retention mechanism 22 is illustrated, it is contemplated that package 70 can be suspended from, or otherwise attached to, any of a variety of holders including those located in a packaging facility or even on the person of a user such as on a utility belt, for example.

Upon breaking an individual elastic band 18 from elastic band package 70, elastic band 18 in an exemplary embodiment has sufficient elastic strength to permit stretching of its loop having an inner circumference defined by aperture 28 to at least three times the size of the relaxed, unstretched inner circumference without fracture of the elastic material. The relaxed, unstretched inner circumference will vary depending on the size of the opening desired for the loop. The relaxed unstretched inner circumference typically ranges from about 1.5 inches (38.1 mm) up to about 10 inches (254 mm) but is not limited to this typical range. In this disclosure, the term "circumference" is loosely used to refer to a perimeter of a closed shape and thus is applicable for describing an edge of an oval, elliptical or other closed polygon or shape (whether symmetrical or asymmetrical) that may or may not be circular.

A width dimension D of elastic band 18 between aperture 28 and outer perimeter cut 30 is adequate to provide requisite strength for the elastic band 18 as it is placed about a product or bundle of products, such as produce that is sold in clumps or groups, for example (not shown). As shown in FIG. 5, an average loop width dimension D for elastic band 18 in exemplary embodiments falls within a range of at least about 0.10 inch (2.54 mm) up to about 0.5 inch (12.7 mm). These widths are especially suitable for thicknesses of elastic panel 16 between about 0.012 inch (0.30 mm) and 0.030 inch (0.76 mm).

In an exemplary embodiment, materials for forming the elastic panel 16 are rubber-like in character. The material desirably recovers from a stretched condition relatively quickly; however, instantaneous retraction or recovery to an original relaxed condition and dimension after stretching is not always critical for functional elastic performance. Substantially instantaneous retraction to a loop inner circumference dimension (defined by aperture 28) no greater than 5 percent above the original unstretched loop inner circumference dimension suffices for a multitude of uses. A substantially instantaneous loop retraction is accomplished when, after having been momentarily stretched to a predetermined extent, it takes no more than 3 seconds for the loop to retract (i.e., recover) to an inner circumference size no more than 5 percent greater than the inner circumference of the original unstretched loop. A momentarily stretched condition is one in which the stretch is not held for more than 3 seconds, and the predetermined extent of the stretch is three times (or more) the inner circumference of the loop in unstretched relaxed condition. There may be occasions where retraction may take possibly up to about 10 seconds and still may constitute sufficiently quick retraction to be useful as elastic material for the purposes of this disclosure. Those skilled in the art of elastic performance features are capable of selecting materials such as elastomers possessing the elastic stretch and retraction characteristics desired for a particular use.

In selecting materials such as elastomers for elastic panel 16, substantially instantaneous retraction is most preferred for rapid bundling of products; slower retraction may allow some product to fall out of the bundle before retraction takes place. On the other hand, a modestly slower retraction may be quite adequate where elastic band 18 is to be stretched about a single product under conditions where speed of retraction (bounce back) is reliable but not the dominant consideration.

Particularly suitable elastomers are those that are thermoplastic in that they at least soften in response to heat, or even melt, to a flowable or moldable state. A multitude of thermoplastic elastomers are known and more are being created. A suitable family of thermoplastic elastomers includes styrenic block co-polymers. This family includes styrene-butadiene styrene and styrene-ethylene-butylene styrene. Another family of useful thermoplastic elastomers include olefinic elastomers, including those that are ethylene based as well as those that are polypropylene based (e.g., where interposed different monomer blocks are not used but blocks of different tacticity—atactic and isotactic—are created by using metallocene catalysis polymerization). Yet another family of thermoplastic elastomers include polyvinyl chloride-based elastomers. Still other families of thermoplastic elastomers can be based on urethanes, nylon, and silicon, for example.

Selection of an elastomer material may take into account factors such as cost and bonding compatibility with a material of header 14. Generally, similar materials tend to bond together (as by polymer bonding) better than dissimilar materials; and materials of like polarity usually bond better than materials of unlike polarity. Thus, header material selection can be made from polymers in the same family as the elastomer, such as those including at least some monomers related to, or the same as those present in, the elastomer chosen for the elastic panel 16. Surface treatments such as corona treatments also help to improve bonding. Still further, compatibilizers that adjust the polarity of material can be used to improve bonding. Additional information is described in U.S. Pat. No. 8,635,795 to Ludlow et al., which is hereby incorporated by reference. A common practice in handling polymeric materials for header 14 and elastic panel 16 is to add compatible (i.e., readily blendable) ingredients to achieve desired properties such as coloration, opacification, resistance to degradation on exposure to environmental conditions, improved impact properties and adhesion properties, for example.

In an exemplary embodiment, elastic panel 16 is substantially uniform in composition throughout its extent. On the other hand, header 14 may be a laminate of different layers, including a possible protective coating over a printed layer, especially a printed layer that is believed to need further protection against smudging or destruction.

Heat welding as by applying heat and pressure on overlapping thermoplastic polymeric materials forming header 14 and elastic panel 16 can be useful to form the bond at bond zone 32. Significant heat at the interface 33 of overlapping thermoplastic polymeric materials can also result in complete fusion between the polymer of header 14 and the polymer of the elastic panel 16. Sonic welding is another way to unify the layers and achieve a cohesive bond between compatible parts. Laminating a molten elastomer to a molten (or at least softened) header material by co-extrusion is another way of forming bond zone 32. This method can be particularly effective where molecules or parts of molecules of the header polymer and the molten elastomer substrate material at the bond zone 32 interdiffuse with each other. Bonds can also be formed by interposing an intermediate layer at the bond zone 32 (e.g., a hot melt bonding adhesive) to which both the header material and the elastic panel material will readily bond because of their compatibility to the intermediate material. Still further, treatment of the surface areas where bonding is to be accomplished can be effective. Even mechanical bonding can be effective, as where the header material is porous (e.g., paper and the porous polymer product called "Teslin"), and the elastomeric layer is applied in molten condition or at least in a softened condition and pressed into the voids or interstices of the porous header layer. Any useful bonding technique and structure that joins the header 14 with the elastic panel 16 in a manner forming a unifying flat bond zone 32 that can withstand delamination in expected use is suitable.

In an exemplary embodiment, elastic band sheet assembly 12 has a high-impact polystyrene header 14 and an elastic panel 16 formed using a styrene-butadiene-styrene (SBS) block co-polymer available from GLS Corporation under the tradename "Kraton D-2104." This co-polymer has several beneficial features such as high clarity, good dimensional stability, food contact acceptability, relatively high strength, low viscosity, ease of coloring, and high elongation. To improve its adhesion to a styrenic header 14, an optional addition of up to 10 percent by weight of polystyrene (based on the weight of the elastomer in the composition) may be blended in the elastomer composition for elastic panel 16. The composition can easily be colored, as for example by using polystyrene base color concentrates from Clariant (of Minneapolis, Minn.) or by using polyethylene base color concentrates from Ampacet (of Tarrytown, N.Y.) at concentrations of up to about 5 percent or more of the weight of the base styrene-butadiene-styrene block co-polymer.

Those skilled in the art will recognize that any suitable process for the manufacture of the new labeling articles of the invention can be employed. Batch processing is useful for limited production runs. Conveyor processing with indexing from station to station for specific operations can be useful, especially for uniquely designed or shaped headers or elastic substrates. An in-line web-based process is especially suitable for manufacturing a web of multiple elastic sheets 12 from the standpoint of economy. Moreover, while elastic band package 70*a* is shown in FIG. 1 as a stack of separate, overlaid elastic sheet assemblies 12, it is also contemplated that an elastic package of the disclosure may have other configurations. For example, as shown in FIG. 4, package 70*b* may be formed of a continuous elastic sheet assembly 12 having a header 14 of indeterminate width (along the horizontal direction) that is folded in an "accordion" style along package side edges 52 to yield a package of multiple overlapping layers or portions that are all connected to each other at header 14 and elastic strip 24. As shown in FIG. 10, as elastic band package 70*c* may be formed of overlapping layers of elastic panel 16 without a header. The overlapping layers of elastic panel 16 may be formed by stacking (similar to the stack of cut sheets of FIG. 1) or by folding (similar to the accordion folded configuration of FIG. 4), for example. An elastic band package (not shown) can also be provided in a spooled configuration, formed by rolling a continuous elastic sheet assembly 12 having a header 14 of indeterminate width (along the horizontal direction, as shown in FIG. 1) upon a spool core or upon itself. While the elastic panel 16 is generally thicker and flimsy, the relatively stiffer but yet flexible header 14 allows for reliable rolling, folding, stacking and other handling procedures. Moreover, an elastic band package (not shown) can also be provided in a spooled configuration, formed by rolling a continuous elastic panel 16 of indeterminate width (along the horizontal direction) upon a spool core (not shown) or upon itself.

Figure 6:
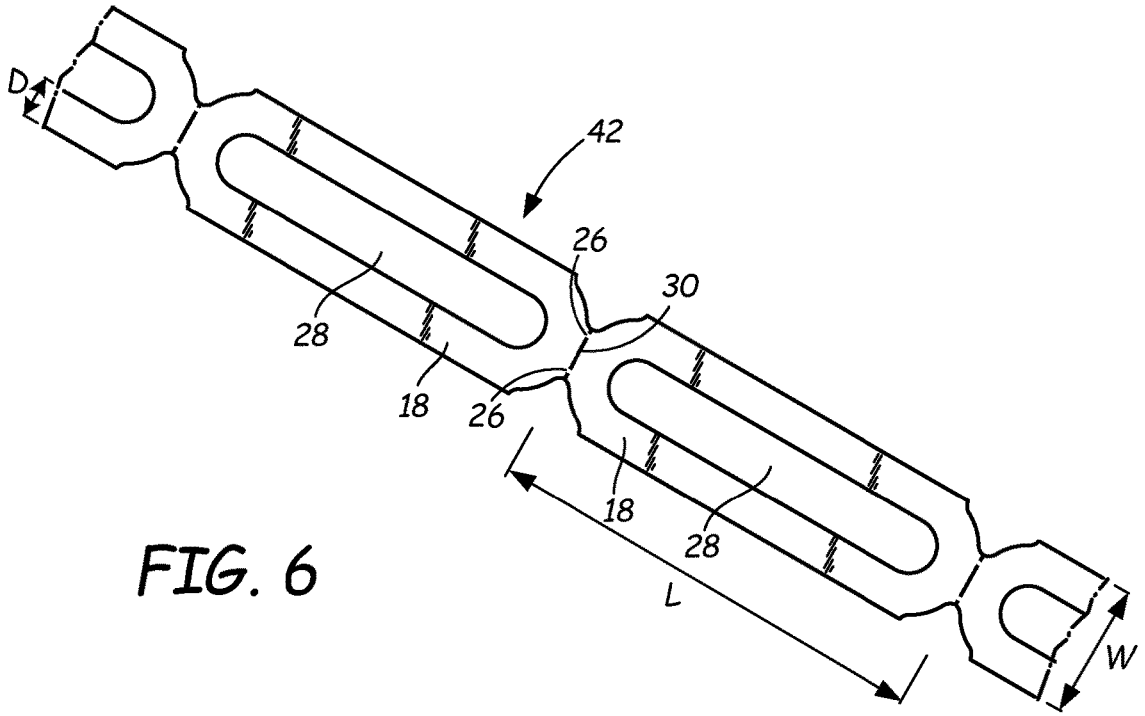
FIG. 6 is a front view of a portion of an endless strip of elastic bands in a second exemplary embodiment of an elastic band package.
Figure 7:
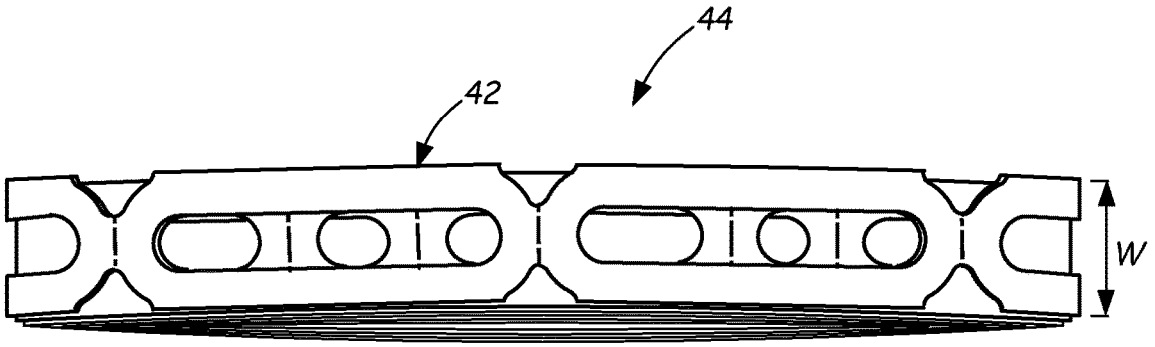
FIG. 7 is a side view of a spool including a rolled configuration of the strip of FIG. 6.

FIG. 6 is a top view of a portion of a strip 42 of indefinite length of ruptureably connected elastic bands 18. In this case, joints 26 are provided between adjacent elastic bands 18. FIG. 7 is a perspective view of a spool 44 including a rolled configuration of strip 42. In spool 44, strip 42 is wound upon an optional core and upon itself and in a manner so that a width of the spool 44 is substantially the same as the width W of a single elastic band 18. In use, spool 44 can be held on a reel or other holder, to allow a user to pull an individual end band 18 off spool 44, and rupture the connections at joints 26, thereby separating the end band 18 from an adjacent band 18 on strip 42.

Figure 8:
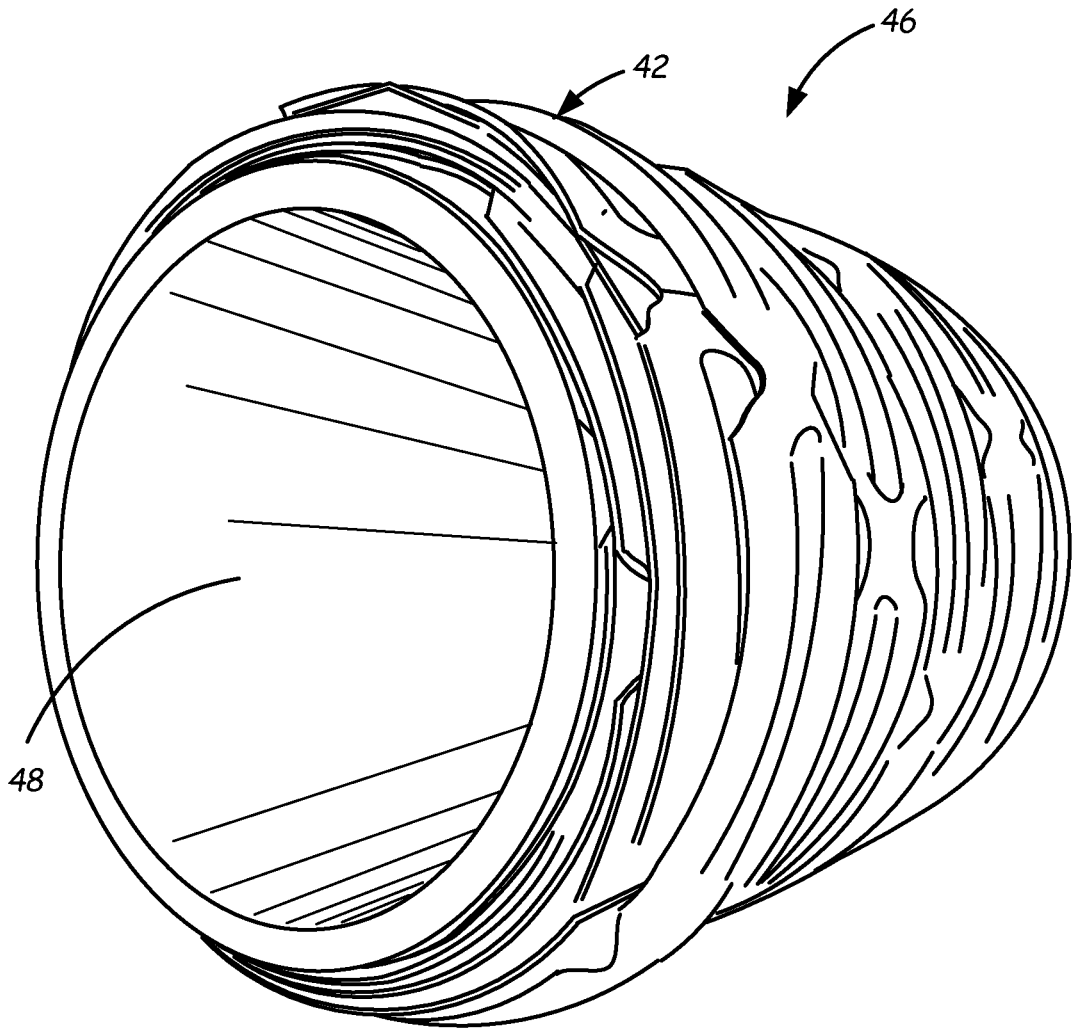
FIG. 8 is a perspective view of another spool configuration of the strip of FIG. 6, wherein the spool core is wider than the strip.

FIG. 8 is a perspective view of another embodiment of a spool 46, having a core 48 of greater width than the width W of strip 42. Such a spool configuration is especially useful when a very long strip 42 is desired. By winding strip 42 about a core 48 having a greater width, the thickness of the wound strip 42 upon core 48 can be reduced, thereby allowing for easier handling of the spool 46.

Figure 9:
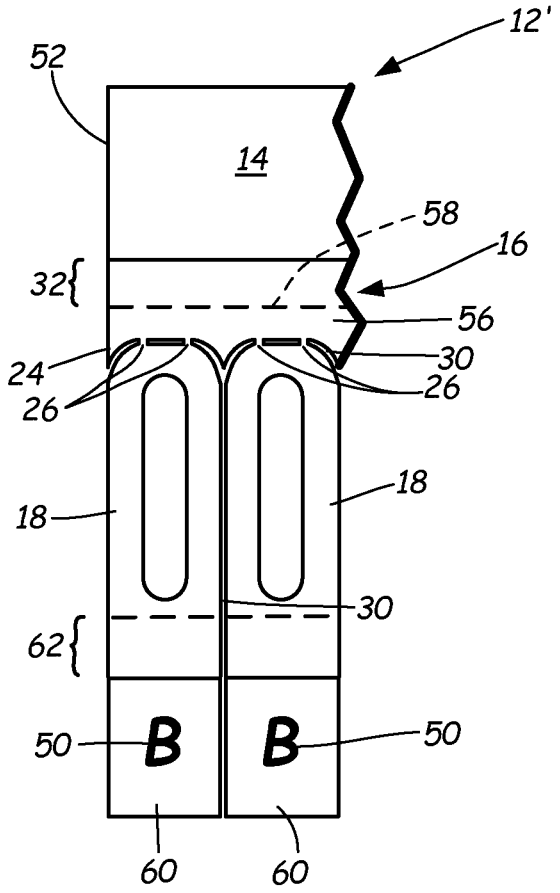
FIG. 9 is a front view of another exemplary embodiment of a portion of a sheet of elastic bands useable in a package similar to that of FIG. 1.
Figure 9A:
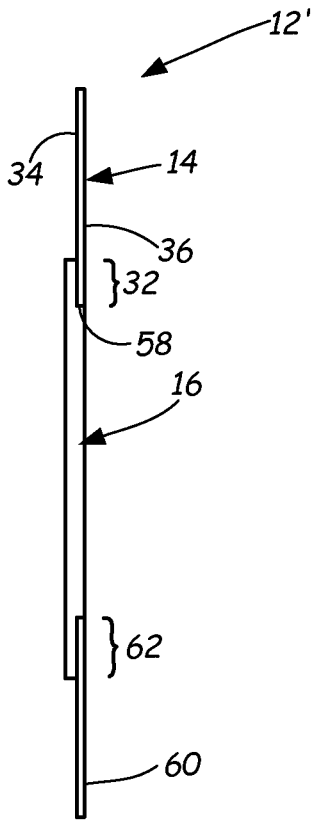
FIG. 9A is an end view of the sheet of FIG. 9, as viewed from the right side of FIG. 9.

FIG. 9 is a front view of another exemplary embodiment of a portion of a sheet 12' of elastic bands 18 useable in a package 70. FIG. 9A is an end view of the sheet 12', taken from a right side of FIG. 9. Sheet 12' of FIG. 9 is substantially similar to sheet 12 of FIGS. 1 and 2 except that a tag 60 is bonded to an end of each elastic band 18 at bond zone 62. Moreover, elastic panel 16 is shown as overlaying front surface 34 of header 14. Tag 60 can be formed from the same or similar materials, using the same or similar methods, as header 14, discussed above. Bond zone 62 can be the same or similar to bond zone 32, discussed above. In an exemplary embodiment, adjacent tags are disconnected from each other, so that each band 18 is connected to elastic strip 24 of sheet 12' only at joints 26. After an elastic band 18 is detached from strip 24 of elastic panel 16 by breaking joints 26, the elastic band with attached tag 60 can be used in the same manner as the labeling article of U.S. Pat. No. 8,635,795 to Ludlow et al; this reference is fully incorporated herein.

FIG. 10 is a front view of a third exemplary embodiment of an elastic band package 70*c* of the present disclosure. FIG. 11 is a partial cross sectional view of an elastic panel 16 of the package 70*c* of FIG. 10, taken along line 11-11 of FIG. 10. In package 70*c*, no header is used. Rather, package 70*c* is formed with overlaid layers of elastic panel 16, which may be stacked, similar to the stacked configuration of package 70*a* of FIG. 1, or folded, similar to the folded configuration of package 70*b* of FIG. 4. Because no header is used, elastic strip 24 may be taller than shown in other configurations, to optionally provide space for attachment features 20 or indicia 50, for example. Elastic strip 24 is more easily viewed in this embodiment of package 70*c* than the embodiments of package 70*a* or 70*b* including header 14. Accordingly, this description discusses some features of elastic panel 16 with reference to this embodiment, though it should be understood that these features also apply to all embodiments of package 70.

In an exemplary embodiment, panel 16 of elastic material includes elastic strip 24 having opposed first and second longitudinal edges. The first longitudinal edge of elastic strip 24 is defined by the top portion of outer perimeter cuts 30. The second longitudinal edge 64 of elastic strip 24 is positioned at the top of the illustrated embodiments. A plurality of elastic bands 18 are rupturably connected to the first edge 26 of the elastic strip 24, each of the bands 18 configured as a loop surrounding a first aperture 28.

Overlapping portions of strip 24 of package 70*c* can be attached to each other, such as by the use of adhesive, mechanical fasteners such as clamps and rivets, or other attachment mechanisms. In an exemplary embodiment, an adhesive layer 38 is optionally disposed on a portion of a surface of elastic panel 16, such as a rear surface thereof, to allow attachment of overlaid portions of strips 24 (of separate elastic panels 16 or a continuous, folded elastic panel 16) to each other to form package 70*c*. Many adhesives are suitable, such as known pressure-sensitive adhesives. Moreover, an exemplary embodiment of elastic panel 16 includes a release liner 40 disposed over the adhesive layer 38 to optionally protect the adhesive layer 38 from fouling and contamination prior to use.

Those skilled in the art will readily recognize that the teachings of this disclosure may be embodied in specific forms other than those illustrated without departing from the essential described characteristics. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

Although the subject of this disclosure has been described with reference to several embodiments, workers skilled in the art will recognize that changes may be made in form and detail without departing from the scope of the disclosure. In addition, any feature disclosed with respect to one embodiment may be incorporated in another embodiment, and vice-versa.

The invention claimed is:

1. An article including:

a panel of elastic material including:

an elastic strip having opposed first and second longitudinal edges; and a plurality of elastic bands rupturably connected to the first edge of the elastic strip, each of the plurality of elastic bands configured as a loop surrounding a first aperture;

a header formed of a sheet material, the header being flatly joined to the elastic strip of the panel;

wherein the header and the panel of elastic material form a sheet assembly, the article including a plurality of said sheet assemblies attached together; and adhesive attaching two adjacent sheet assemblies of the plurality of said sheet assemblies together.

2. The article of claim 1 further including a mechanical fastener attaching two adjacent sheet assemblies of the plurality of said sheet assemblies together.

3. The article of claim 1, wherein each of the plurality of elastic bands is disconnected from each of the other plurality of elastic bands.

4. The article of claim 1, wherein the header overlaps a first side of the elastic strip at an interface, and wherein the elastic strip is bonded to the header at the interface.

5. An article including:

a panel of elastic material including:

an elastic strip having opposed first and second longitudinal edges; and a plurality of elastic hands rupturably connected to the first edge of the elastic strip, each of the plurality of elastic bands configured as a loop surrounding a first aperture;

a header formed of a sheet material, the header being flatly joined to the elastic strip of the panel;

wherein the header and the panel of elastic material form a sheet assembly, the article including a plurality of said sheet assemblies attached together; and wherein each of the headers of the plurality of said sheet assemblies includes a second aperture, and wherein said second apertures are aligned to permit passage of a retention mechanism therethrough.

6. The article of claim 5 further including a mechanical fastener attaching two adjacent sheet assemblies of the plurality of said sheet assemblies together.

7. The article of claim 5, wherein each of the plurality of elastic bands is disconnected from each of the other plurality of elastic bands.

8. The article of claim 5, wherein the header overlaps a first side of the elastic strip at an interface, and wherein the elastic strip is bonded to the header at the interface.

9. The article of claim 5 further including a tag strip attached to the plurality of elastic bands.

10. An article including:

a panel of elastic material including:

an elastic strip having opposed first and second longitudinal edges; and a plurality of elastic bands rupturably connected to the first edge of the elastic strip, each of the plurality of elastic bands configured as a loop surrounding a first aperture; and a header formed of a substantially inextensible sheet material, the header being flatly joined to the elastic strip of the panel.

11. The article of claim 10, wherein each elastic band has a length between opposed first and second ends and a width that is perpendicular to the length, and wherein the first end of each of the elastic bands is rupturably connected to the elastic strip.

12. The article of claim 11, wherein the length is greater than the width.

13. The article of claim 10, wherein each of the plurality of elastic bands is disconnected from each of the other plurality of elastic bands.

14. The article of claim 10, wherein the header overlaps a first side of the elastic strip at an interface, and wherein the elastic strip is bonded to the header at the interface.

15. The article of claim 14, wherein an exposed portion of the first side of the elastic strip is provided adjacent the interface.

16. The article of claim 10 including a plurality of overlapping layers of the elastic material.

17. The article of claim 10, further including a second aperture configured to permit passage of a retention mechanism therethrough.

18. The article of claim 10 further including a tag strip attached to the plurality of elastic bands.

19. The article of claim 18, wherein the tag strip is demarcated into a plurality of tags, wherein one of the plurality of tags corresponds to each of the plurality of elastic bands.

20. The article of claim 10 wherein the header and the panel of elastic material form a sheet assembly, and wherein the sheet assembly is folded to form overlapping portions.

* * * * *